US011612827B2

(12) United States Patent
Müller et al.

(10) Patent No.: US 11,612,827 B2
(45) Date of Patent: Mar. 28, 2023

(54) PLASTIC TOY BRICK HAVING ELECTRICAL CONTACTS FOR ELECTRONICALLY DETERMINING THE POSITION OF SAID TOY BRICK IN THE INSTALLED STATE AND METHOD FOR PRODUCING SAID TOY BRICK

(71) Applicant: Stephan Müller, Hemishofen (CH)

(72) Inventors: Stephan Müller, Hemishofen (CH); Urs Fässler, Winterthur (CH); Erik Alexandersson, Taoyuan (TW); Lucas Carpenter, New Taipei (TW)

(73) Assignee: Stephan Müller, Hemishofen (CH)

( * ) Notice: Subject to any disclaimer, the term of this patent is extended or adjusted under 35 U.S.C. 154(b) by 0 days.

(21) Appl. No.: 16/089,908

(22) PCT Filed: Aug. 26, 2016

(86) PCT No.: PCT/EP2016/070262
§ 371 (c)(1),
(2) Date: Sep. 28, 2018

(87) PCT Pub. No.: WO2017/036994
PCT Pub. Date: Mar. 9, 2017

(65) Prior Publication Data

US 2019/0118107 A1 Apr. 25, 2019

(30) Foreign Application Priority Data

Aug. 31, 2015 (CH) ..... 01252/15

(51) Int. Cl.
*A63H 33/04* (2006.01)
*A63H 33/08* (2006.01)

(52) U.S. Cl.
CPC ..... *A63H 33/042* (2013.01); *A63H 33/086* (2013.01)

(58) Field of Classification Search
CPC ..... A63H 33/042; A63H 33/086
(Continued)

(56) References Cited

U.S. PATENT DOCUMENTS 3,346,775 A * 10/1967 Godtfred ..... H05K 1/0286 361/738
4,552,541 A * 11/1985 Bolli ..... A63H 33/042 446/91
(Continued)

FOREIGN PATENT DOCUMENTS

CN 103480159 A 1/2014
EP 1271415 A1 1/2003
(Continued)

OTHER PUBLICATIONS

International Search Report; PCT Application No. PCT/EP2016/070262; dated Sep. 3, 2017.
(Continued)

*Primary Examiner* — Joseph B Baldori
(74) *Attorney, Agent, or Firm* — Polsinelli PC

(57) ABSTRACT

The plastic toy building block is provided with electrical contacts to determine its position. The block has a basic body having recesses extending from top to bottom in its interior. In these are each inserted, combined into packets, several discrete elastically resilient conductor wires clamped between plastic strips. Elastically resilient conductor wires protrude downward into the recess. Contact points protrude from the plastic strips at the top. Several electrical cables are led from each nub to the underside of a nub plate to discrete contact points. Except for the nub surfaces, the nub plate can be covered by a cover plate and hereafter can be placed with the nub plate on the basic body of the toy building block.
(Continued)

The lower contact points on the film then make electrical contact with the upper stubs and thus with contact points of the conductor wires.

10 Claims, 12 Drawing Sheets

(58) Field of Classification Search
USPC ..... 446/91
See application file for complete search history.

(56) References Cited

U.S. PATENT DOCUMENTS

| | | | | |
|---|---|---|---|---|
| 4,556,393 | A * | 12/1985 | Bolli | A63H 33/042 446/91 |
| 4,743,202 | A * | 5/1988 | Bach | A63H 33/042 439/53 |
| 4,883,440 | A | 11/1989 | Bolli | |
| 6,805,605 | B2 * | 10/2004 | Reining | A63H 33/086 446/484 |
| 8,690,631 | B2 * | 4/2014 | Nag | A63H 33/042 446/125 |
| 8,764,507 | B2 * | 7/2014 | Lin | A63H 33/042 446/91 |
| 9,128,661 | B2 * | 9/2015 | Zilber | A63F 3/00643 |
| 9,333,438 | B2 * | 5/2016 | Lee | A63H 33/086 |
| 9,457,287 | B1 * | 10/2016 | Lin | A63H 33/042 |
| 9,914,066 | B2 * | 3/2018 | Cletheroe | A63H 33/046 |
| 10,512,853 | B2 * | 12/2019 | MacDonald | A63H 33/046 |
| 10,847,046 | B2 * | 11/2020 | Bellamy | A63H 33/042 |
| 10,960,319 | B2 * | 3/2021 | Zeng | A63H 33/042 |
| 2008/0166926 | A1 * | 7/2008 | Seymour | A63H 33/086 439/701 |
| 2009/0305602 | A1 * | 12/2009 | Gaute | A63H 33/042 446/91 |
| 2011/0021107 | A1 * | 1/2011 | Nag | A63H 33/042 446/91 |
| 2013/0109268 | A1 * | 5/2013 | Lin | A63H 33/042 446/91 |
| 2014/0302740 | A1 * | 10/2014 | Nag | A63H 33/042 446/91 |
| 2015/0072585 | A1 | 3/2015 | Chia-Yen | |
| 2015/0133023 | A1 * | 5/2015 | Lewis | A63H 33/26 446/91 |
| 2018/0233856 | A1 * | 8/2018 | Brandwijk | A63H 33/042 |
| 2019/0118107 | A1 * | 4/2019 | Muller | A63H 33/042 |
| 2020/0391134 | A1 * | 12/2020 | Hansen | A63H 33/26 |

FOREIGN PATENT DOCUMENTS

| | | | |
|---|---|---|---|
| EP | 3436169 | B1 | 4/2020 |
| WO | 20170036994 | A1 | 3/2017 |

OTHER PUBLICATIONS

English Translation of International Search Report; PCT Application No. PCT/EP2016/070262 dated Sep. 3, 2017.
Written Opinion of PCT Application No. PCT/EP2016/070262; dated Sep. 3, 2017.
English Language Abstract of CN103480159; Retreived From www.espacenet.com on Sep. 27, 2018.

* cited by examiner

PLASTIC TOY BRICK HAVING ELECTRICAL CONTACTS FOR ELECTRONICALLY DETERMINING THE POSITION OF SAID TOY BRICK IN THE INSTALLED STATE AND METHOD FOR PRODUCING SAID TOY BRICK

CROSS-REFERENCE TO RELATED APPLICATIONS

This application is a national stage entry of PCT/EP2016/070262 filed Aug. 26, 2016, which claims convention priority from Swiss patent application 00422/16 filed on Mar. 31, 2016, the contents each of which are hereby incorporated by reference in their entirety.

FIELD

This invention relates a plastic toy building block which is equipped with electrical contacts on its upper side and underside, so that it can be mechanically and electrically connected at the top and bottom to an identical or similar toy building block. With it, the position of a component can be determined in the installed state in a structure of such building blocks, and many further applications can be derived from this position determination. Furthermore, the invention relates to a method for the efficient industrial manufacture of such a game toy building block.

BACKGROUND

From WO 2009/100051 a building block having input and output contacts is known, so that a single building block can be electrically connected to adjacent building blocks of the same design, enabling an interaction. A central host device as the host computer can manage the electrical signals and in this way make a video game having physical interaction possible by the individual building blocks and the structure created with them. This document shows a plurality of possibilities of interactions which are realizable with building blocks if they can make such contacts possible among one another and communicate electrically with the host device and its print board with its logical connections.

On the account of the disclosure content of the WO 2009/100051, it is not necessary to deal here with all these variants and possibilities which such a building block opens up. In any case, they are highly suitable, among other things, for the efficient establishment and promotion of the three-dimensional imagination of children and adolescents and therefore have a high educational effect on those who deal with them and create spatial structures.

However, the basic requirement for such a system as shown in WO 2009/100051 is the plastic toy building block. In order to be able to establish such a system in the market at all, it has to be convincing in several respects, and there has been a lack of such a system so far. For this purpose, the plastic building blocks must be sufficiently clamped when fitted together and must remain so for a long time, even after years. This alone is a huge challenge and the market leader LEGO has acquired a great deal of expertise in this area. The tiniest tolerances in manufacturing prove to be extremely important, in addition to the choice of a suitable plastic material. Much the same applies to the new electrical contact options to be introduced. They must function absolutely reliably and likewise permanently, i.e. even after dozens of connections and separations from other building blocks have been made, and also bearing in mind the ageing of the building blocks. Even after several years, no loose electrical contacts may occur after plugging together, otherwise the building blocks become worthless for the system. Therefore producing such a building block from plastic represents an exceptionally demanding technical task in many respects. The first challenge is to ensure that the mechanical clamping force during assembly of the building blocks is sufficient and durable. The second challenge is to find a technical solution that ensures that the electrical contacts between the blocks also function perfectly when they are fitted together, and that this is also permanent, even when the building blocks and thus the contacts are repeatedly fitted together and separated again. A third challenge is to realize such contact connections with a minimum of parts. A fourth challenge is to design the components of the building block in such a way that the assembly can be carried out efficiently and preferably purely mechanically, so that the manufacturing costs can be reduced to an acceptable level. And finally, the fifth challenge may be that the electrical contacts should be so robust and protected that throwing, falling, stepping on or any other mechanical stress on the building blocks cannot harm the electrical contact elements, i.e. cannot cause distortion, breakage or other damage to contact wires.

The task of the invention is therefore to specify a plastic toy building block having electrical contacts for the electronic determination of its position in the installed state, which ensures a safe and permanent clamping when assembled with another identical or similar building block, further enables a permanently safe electrical connection of the contacts, even after multiple disconnection and reassembly of the building blocks, and which consists of a minimum of components, whereby these components should be efficiently and as far as possible mechanically mountable, for a cost-effective production of the plastic toy building blocks in large series.

Furthermore, it is a task of the invention to state an efficient and industrially feasible process for the manufacture of such a toy building block which permits serial and automated production.

This task is solved by a plastic toy building block having nubs on its upper side, wherein the underside of which can be plugged onto the upper side and there onto the nubs of a similar plastic toy building block upon development of a clamping force, which distinguishes itself by the fact that resilient conductor wires are guided from the underside of the plastic toy building block through its interior via a contact interface to its top side, so that three conductor wires are each guided to at least one flank or top side of each nub, for the electronic determination of its position in the installed state with a further plastic toy building block of the same type, and wherein the plastic toy building block consists of a basic body having recesses passing through from top to bottom, and having insert parts for inserting and holding several conduct or wires, which can be brought into electrical contact with one another upon fitting together two plastic toy building blocks of the same type, over the height of the plastic toy building block, so that the relative position of the two toy building blocks relative to one another can be determined electronically depending on the electrical connections made between two plastic toy building blocks lying on top of each other, i.e. between the lower ends of the conductor wires of the upper plastic toy building block and the upper ends of the electrical lines on the nubs of the lower plastic toy building block.

Further, the task is solved by a method for the industrial production of a plastic toy building block having electrical contacts for electronically determining its position in the installed state.

BRIEF DESCRIPTION OF THE DRAWINGS

In the Figures, this toy building block is shown in three variants and different views and with the help of these representations it is described in the following, and its structure, its production and composition and its function are explained.

There is shown.

DETAILED DESCRIPTION

Figure 1:
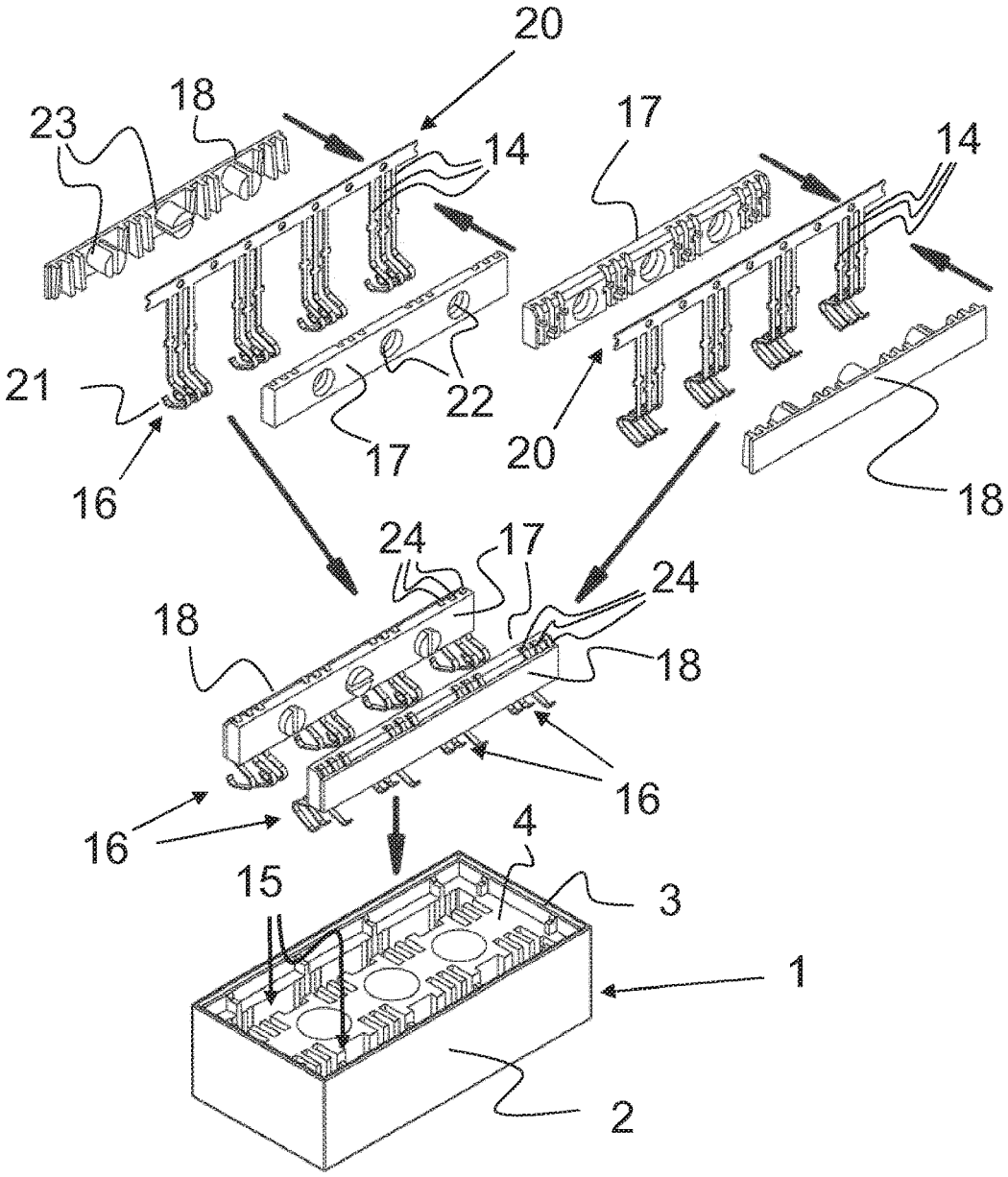
FIG. 1: The individual inner components for the electrical functionality of a first variant of the toy building block, and indicated by arrows in which direction they are assembled.

The plastic toy building block is equipped with electrical contacts for electronically determination its position in the installed state. For this purpose, in a first embodiment variant according to FIGS. 1 to 14 it consists first of all, as shown in FIG. 1 at the bottom, of a cubic basic body 1 having a square outline and an all-round lateral wall 2 and inside this basic body 1 of a structure having recesses 15. At this point it should be mentioned that this basic body does not necessarily have to be cubic. A circular or cylindrical designed basic body can also be used in the same way, or a basic body with an L-, U-, F- or E-shaped outline, or other designs, which basically make the structure described here possible. As one recognizes with the help of FIG. 4, the circumferential edge 3 projects upwards a bit at the top, thus forming a bottom 4 which is set off downwards from this upper edge 3. On this bottom 4, a nub plate 5 having nubs 6 can be inserted in an accurately fitting fashion. In the example shown, these are cubic nubs. It is clear that circular or differently shaped nubs can also be realized in the same way. The simply have to enable a clamping with the underside of a basic body belonging to the basic body. What this nub plate 5 is all about will become clear later with the help of the description of FIG. 3. Of course, the implementation of the basic body and the associated cover plate can also be realized in reverse, in which case the cover plate has a collar projecting downwards and sits on the basic body, in which the upper edge thereof forms an inwardly offset step, or the cover plate has a collar projecting downwards which is slightly offset inwards so that it forms a circumferential step which can be placed on the basic body. In addition, the two building blocks could also be positioned on top of each other using screw mandrels. Whatever the solution is reached in detail, a cover plate is placed on top of the basic body to fit precisely and immovably, and securely held in place by means of clamps or click connections. As an alternative to clamping or clicking together, the components can also be permanently joined together by screwing, welding or gluing.

First, the inner parts of the toy building block are described as shown in FIG. 1. At the top left, one can recognize an electrical mounting conductor 20, from which four triple packets 16 of resilient conductor wires branch downwards, which are curved at the bottom into a horizontal V-shape, having the end of the free leg of the V curved upwards. Thus a curved resilient contact point 21 is formed at the bottom of each conductor wire 14. A plastic strip 17, 18 is visible on each side of the electrical mounting conductor 20. The plastic strip 17 shown in the picture closer to the viewer has three holes 22. Diametrically split holding pins 23 on the second plastic strip 18 fit these holes 22. These two plastic strips 17, 18 can be snapped together while enclosing and clamping the electrical conductor 20, whereby the retaining bolts 23 are clawed or clicked into the holes 22. Hereafter, the mounting conductor 20 is cut off and the remaining small stubs of the clamped conductor wires 14 are bent over. They thus form three different contact points 24 for each packet of conductor wires 14. For each toy building block there are two such mounting conductors 20 having the two plastic strips 17, 18 clamping them. A bit further to the right in the image one sees the second unit. Here, the two plastic strips 17, 18 are visible straight on from the other side. The two brackets completed in this way for each of the four conductor wire packets 16, after breaking away or cutting away the mounting conductor 20, are then shown in the picture below, each clamped between its two adjacent plastic strips 17, 18.

From this position they are inserted into the toy building block, whose structure, as already mentioned, forms two recesses 15, into which these units fit with their conductor wire packets 16 of each three conductor wires 14. Hereafter the toy building block presents itself as shown in FIG. 4.

Figure 2:
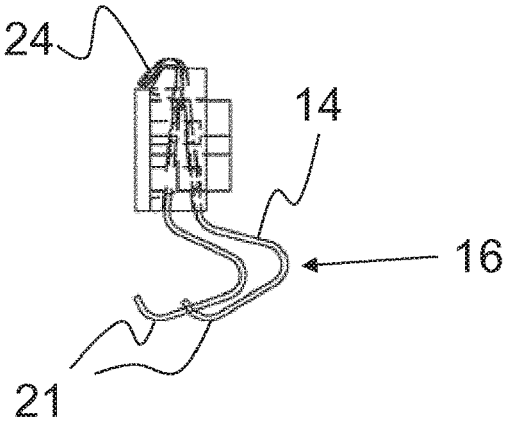
FIG. 2: The strips with the clamped conductor in a front view.

FIG. 2 shows the conductor wires 14 clamped by the two plastic strips 17, 18 in a view on the front side of the plastic strips. The conductor wires 14 of the triple packet 16 protrude from the bottom of the plastic strips 17, 18 and are bent to lying V with each an end 21 curved at the top. Thus they form an elastically resilient contact surface at the very bottom. The protruding stubs of the conductor wires 14 are also bent at the top and there form the contact points 24.

Figure 3:
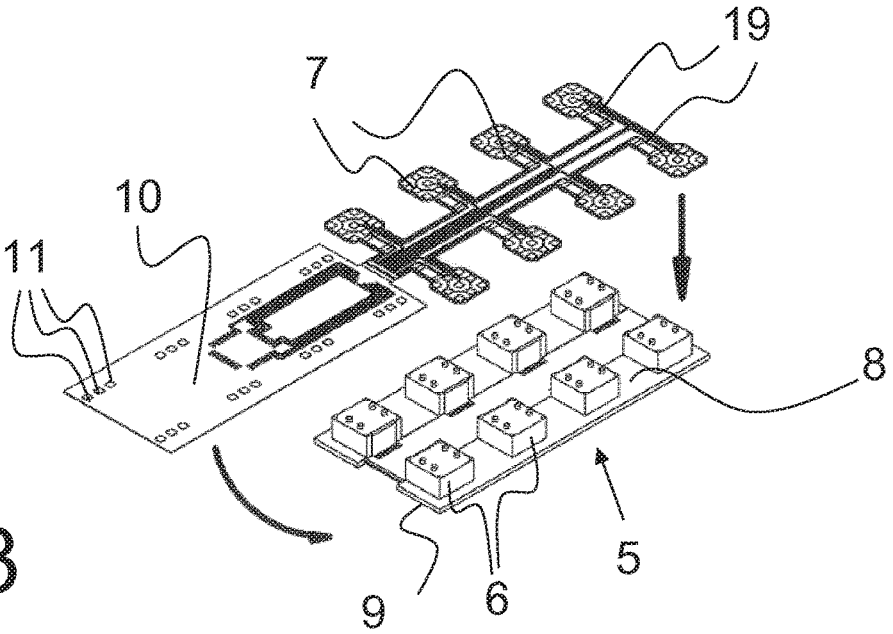
FIG. 3: The lid carrier of the toy building block having the electrical circuit board and with arrows indicating in which direction these parts are assembled.

FIG. 3 shows the electrical equipment of the nub plate 5. An electrical contact film 7, produced for example by punching or laser cutting, can be placed on this nub plate 5, which is shown in FIG. 3 above. The upper sides of the nubs 6 are covered congruently by this contact film 7 when the nubs are applied and their electrical connections are guided from the upper side of the nubs 6 along the lateral faces of the nubs downwards to the upper side 8 of the nub plate 5. Thereafter, they run over this upper side 8 outwards to the one narrow edge 9 of this upper side 8, and then beyond this edge 9 into a film 10 having integrated individual contact points 11 for each electrical line, which are led to from the various nubs 6. This film 10 is swiveled, as shown in FIG. 3 around the curved arrow, i.e. downwards around the edge 9 of the nub plate 5, so that hereafter it comes to lie on the underside of the nub plate 5.

Figure 4:
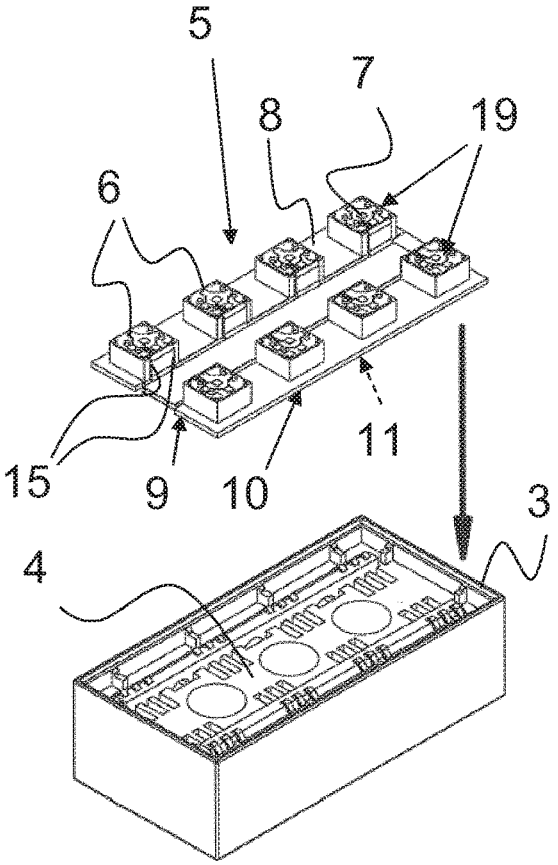
FIG. 4: The lid carrier of the toy building block having the electrical circuit board mounted on it, and indicated by an arrow how it is placed on the basic body of the toy building block.

In FIG. 4 one recognizes the nub plate 5 equipped with the contact film 7 and its film 10. One recognizes the contact film 7 on the nubs 6. The electrical cables 19 running thereon lead from each nub 6 first along its lateral wall down to the nub plate 8 and hereafter on the contact film 7 to the narrow edge 9 of the nub plate 8, where this film 7 is transferred with its electrical cables 19 into the now folded film 10, and whose individual contact points 11 are now directed downwards, and thus not visible here. In this state, the nub plate 5 is placed on the bottom 4 of the toy building block as indicated by the arrow.

Figure 5:
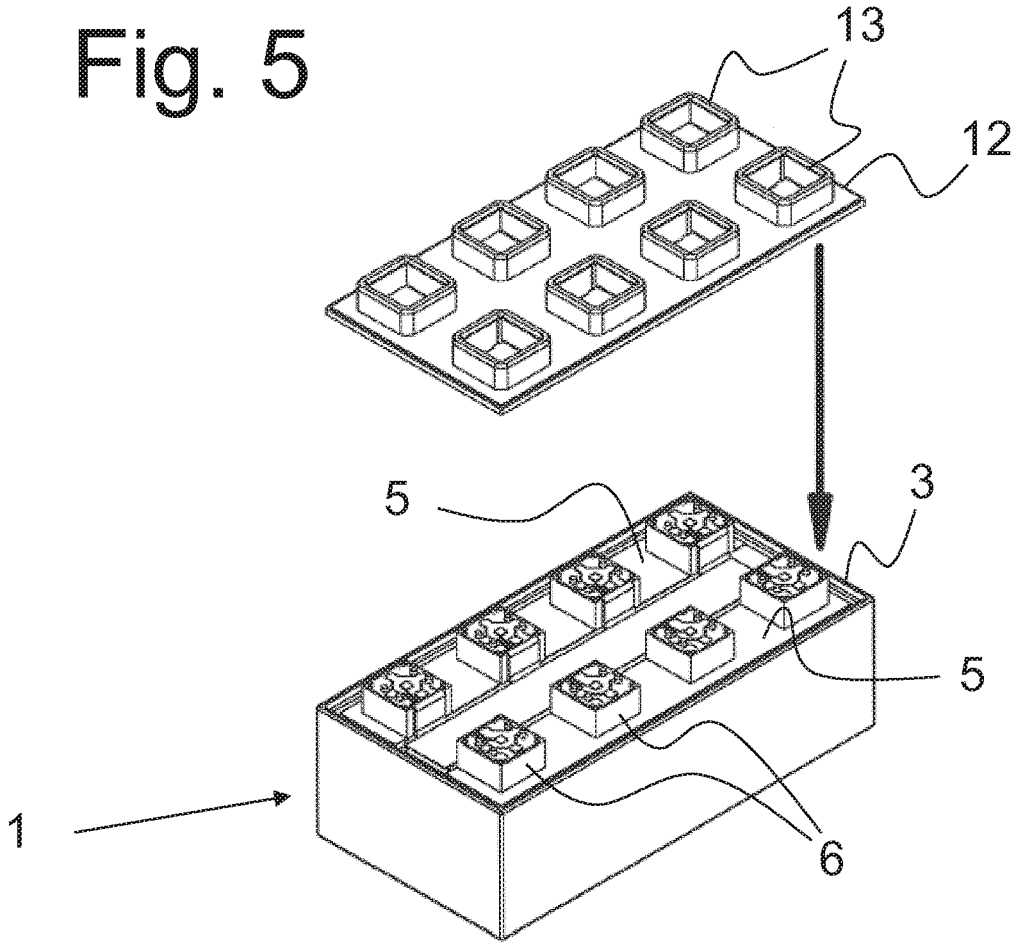
FIG. 5: The toy building block having the lid part, and the arrow showing how the lid part is placed on the lid carrier.
Figure 6:
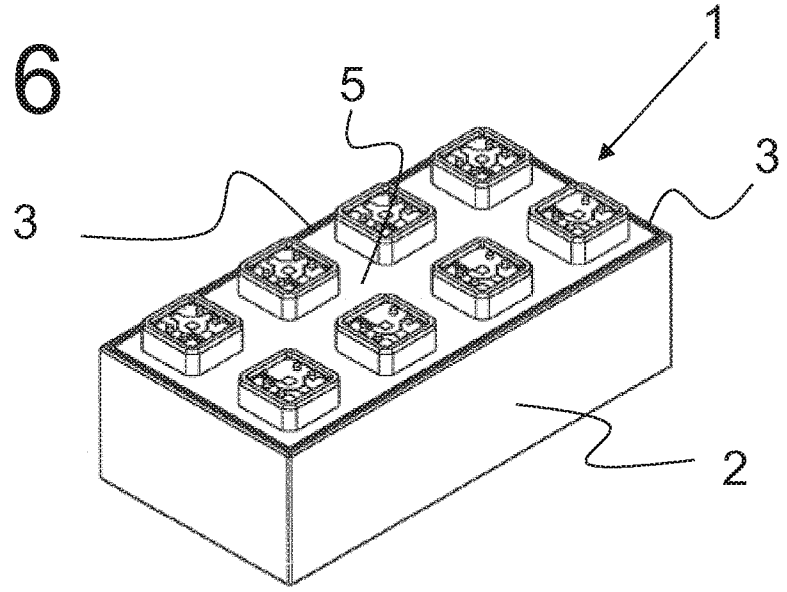
FIG. 6: The fully assembled toy building block.

Now the state is reached as shown in FIG. 5 at the bottom. Above this picture one can see a cover plate 12 with eight square frames 13 projecting upwards. This cover plate 12 can be placed on the nub plate 5, as shown by the arrow, so that in the attached state the eight frames 13 each surround one nub 6 at the sides and the cover plate 12 can be snapped into place on the circumferential edge 3 of the plastic toy building block, i.e. on an inner bead on the same. The recesses in the cubic basic body 1 are still accessible from below. The FIG. 6 shows the fully assembled plastic toy building block.

Figure 7:
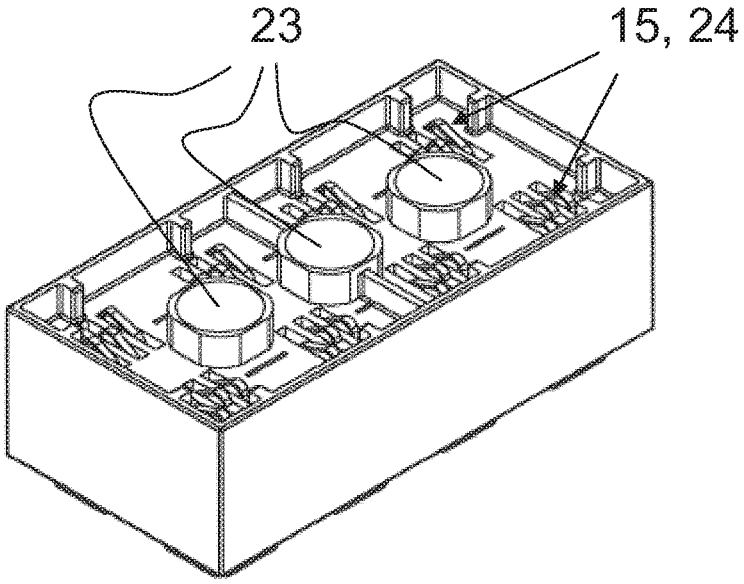
FIG. 7: The completed toy building block shown in a perspective view from below.

In FIG. 7, this toy building block is placed upside down on the upper side, so that one can see the underside. One can therefore see the recesses 15 into which the contact wires in the toy building block project from top to bottom.

Figure 8:
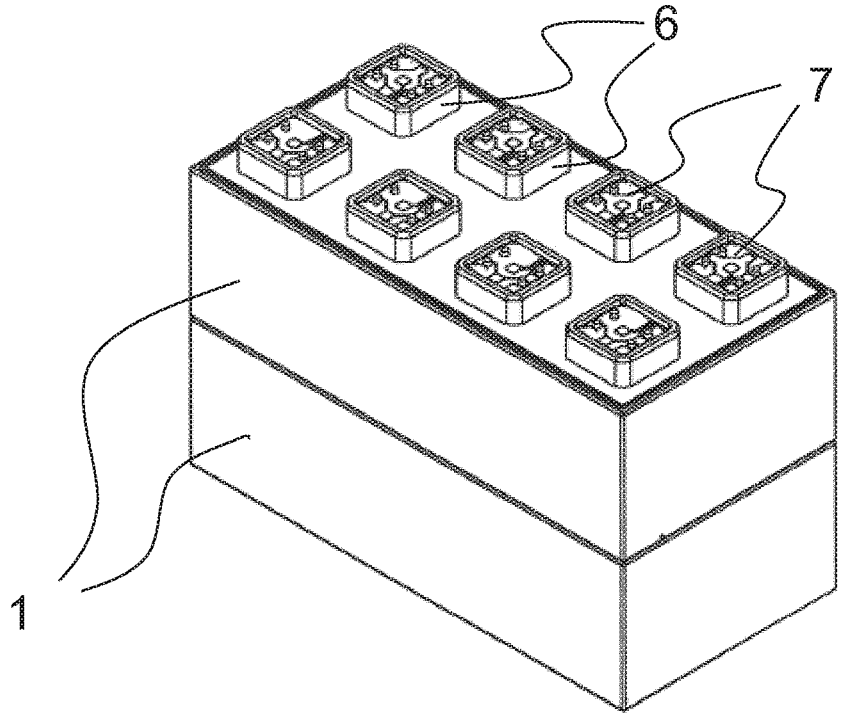
FIG. 8: Two toy building blocks placed on top of each other by clamping force.

Correspondingly, one can see here the lower ends of the contact wires or the conductor wires 14, namely the contact points 24. Furthermore, one recognizes the plastic-clamping tubes 23 which are arranged in conventional manner to ensure a good and permanent clamping seat of the toy building block in the nubs 6 of that toy building block of identical design on which it is fitted to. In FIG. 8 two such toy building blocks are put together on top of each other. On account of the clamping forces generated as a result of the geometry of the nubs 6 and the clamping tubes 23, these cling to each other. On the upper side of the toy building block, one recognizes the contact film 7 on the upper side of the nubs 6, which communicate with the contact points 11 of the folded film 10, whereby for each nub 6 in the example shown three contact wires resilient by curvature or conductor wires 14 are held in place on both sides as a triple packet 16 by the terminal strips 17, 18. In the example shown here, the terminal strips 17, 18 can be snapped into the recesses 15 so that the upper ends of the conductor wires 14 each form a contact point 24 and each contacts a different contact point 11 on the folded film 10. It is clear that according to the same principle, also less or more conductor wires can be incorporated in this manner between each two terminal strips. Furthermore, the terminal strips can also be permanently clamped into the recesses simply by pressing them slightly instead of clicking them in.

Figure 9:
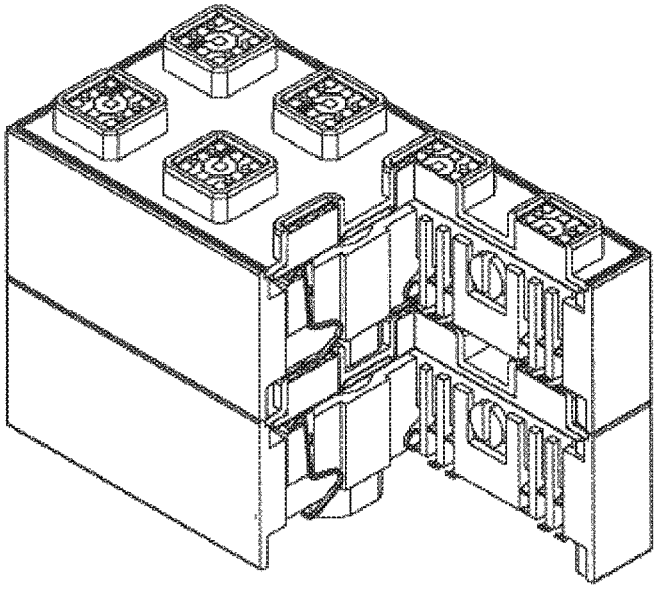
FIG. 9: The two toy building blocks built on top of each other from FIG. 8 in a partial section.

In FIG. 9, the two toy building blocks fitted on top of each other from FIG. 8 are depicted in a partial section, which reveals the view into the interior. As one can recognize, the contact points 11 on the contact film 7 of each nub 6 lead via the electrical lines 19 on the film 10 to very individual conductor wires 14 protruding into the recesses 15 and are electrically contacted by their lower ends 24. By fitting two such toy building blocks on top of each other, the conductor wires 14 of the upper toy building block are electrically connected to the contact points of the contact film 7 on the nubs 6 of the lower toy building block. Each nub 6 has nine contact points at the top—arranged on its contact film 7 in three rows and three columns. In doing so, the central contact point serves as a data conductor, while altogether four different average contact points serve on the edge than grounding, and four different contact points in the corners of the nub 6 as a conductor. This makes it possible to recognize whether two toy building blocks are connected to each other, and if so, in which configuration, based on the current-carrying connections in each case, wherein this a variety of possibilities. Thus, two toy building blocks can be congruently fitted on top of each other, or partially overlapping, and they can also be fitted on top of each other at a right angle to each other, at the edge, in the middle or at the other edge etc., i.e. offset in line. The electrical signals can be captured and centrally evaluated by a data processing system, for example a terminal device in the form of a pad, phone or PC, so that a virtual toy building block image can be generated on the screen of a computer, which represents the structure assembled in reality.

This technology is already developed and known. The challenge, however, was to design a simple, foolproof concept for such a toy building block so that it would meet the necessary requirements in terms of clamping force, and the electrical connections would remain permanently functional. Here this is ensured by the resilient conductor wires 14. As long as these are strained within the scope of their elastic springs, these springs do not wear out and the functionality for establishing electrical connections with contact points on the nubs 6 is maintained.

Figure 10:
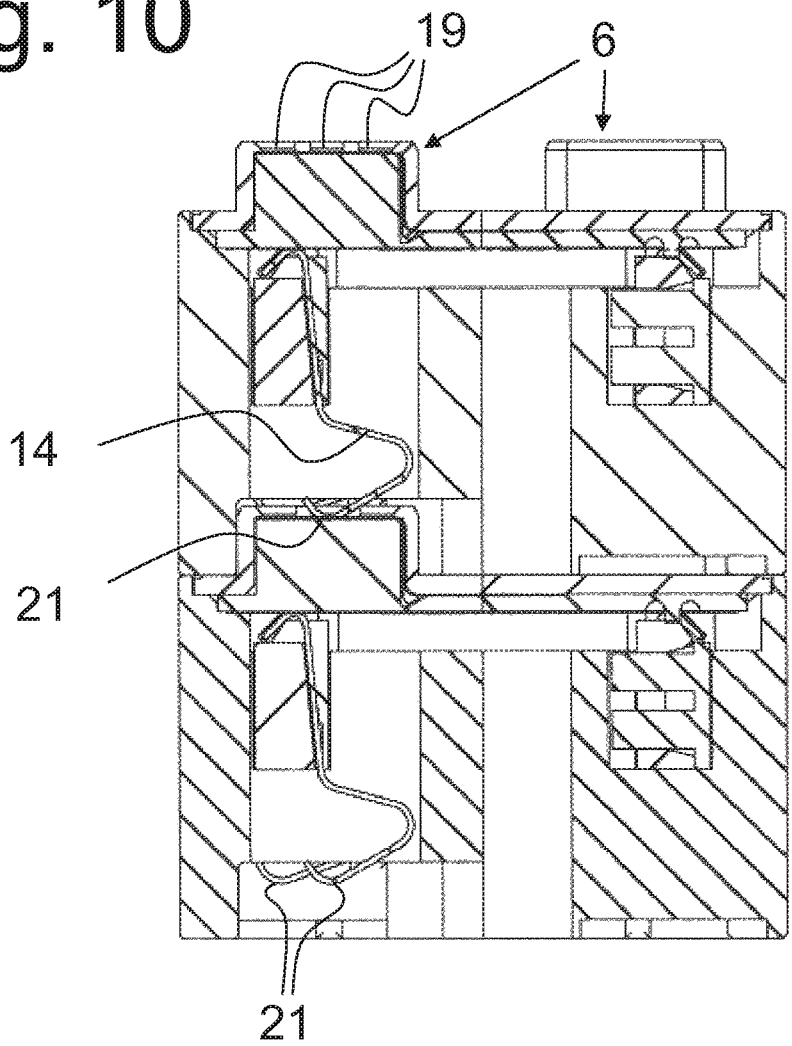
FIG. 10: A cross-section in an enlarged scale of the two toy building blocks from FIG. 8 fitted on top of each other.

The electric conductor from above, from a conductor 19 or contact point on the nubs 6 down to the contact point 21 of a conductor wire 14 of a lower toy building block is shown in FIG. 10, which shows a cross-section of two toy building blocks fitted on top of each other as shown in FIG. 9 in an enlarged scale. Of importance for the proper electrical function, i.e. for the electrical connection of the toy building blocks, is a low resistance value of the connections. This makes large assemblies possible. Thanks to this electrical wiring, these toy building blocks offer the possibility of visual, audible, tactile feedback, for example for the construction of prototypes with LEDs, loudspeaker functions on the terminal device, etc. The LEDs can be parts of the block. For this purpose two positions can be used on the conductor film, including series resistors. A microcontroller can also be integrated in the conducting film. The central contact point can serve as a data conductor—data which is essential for processing to create [sic] a particular shape. The conceptual logic of interconnection and communication, as already described in WO 2009/100051, then comes into play and is not further elaborated here. These toy building blocks can be operated without a battery because the power supply comes from a base plate or from the basic building block and is distributed to the individual connected or fitted toy building blocks. The solution presented here offers 3×3 contacts per nub, i.e. 9 plus and 9 minus contacts per nub. Normally, a toy building block having 2 rows having 4 nubs each would require a total of 2×4×3×3=72 plug connections, while the one presented here only requires 24 spring contacts for the same function, namely with 2×4 conductor wire packets having 3 conductor wires each 14, i.e. 2×4×3=24 spring contacts. Furthermore, is not evident from outside how the contacting is organized inside. This solution is economical and effective. The contacting with cluster-manufactured stamped bent parts also serves to reduce costs. A complete row of contacts is bent uniformly. The different positioning is effected after insertion into a contact carrier. If the contacts are embedded and positioned, the connecting punching strip is cut off and the contacts are thereby separated. The handling of a plurality of individual contact springs would be comparatively much more elaborate. And instead of two terminal strips which can be snapped together, for a mass production the conducting wire packets of each 4×3 contact wires can be overmolded also on both sides with plastic, whereupon then the connecting conductor strip is punched away or cut off. The conductor wires are then cast into a single plastic part and can be mounted in the recesses. In the very best embodiment, the individual toy building blocks can be supplied with power via HF induction and, thanks to accelerometers, can transmit their position wirelessly to a base station via Near Field Communication.

Figure 11:
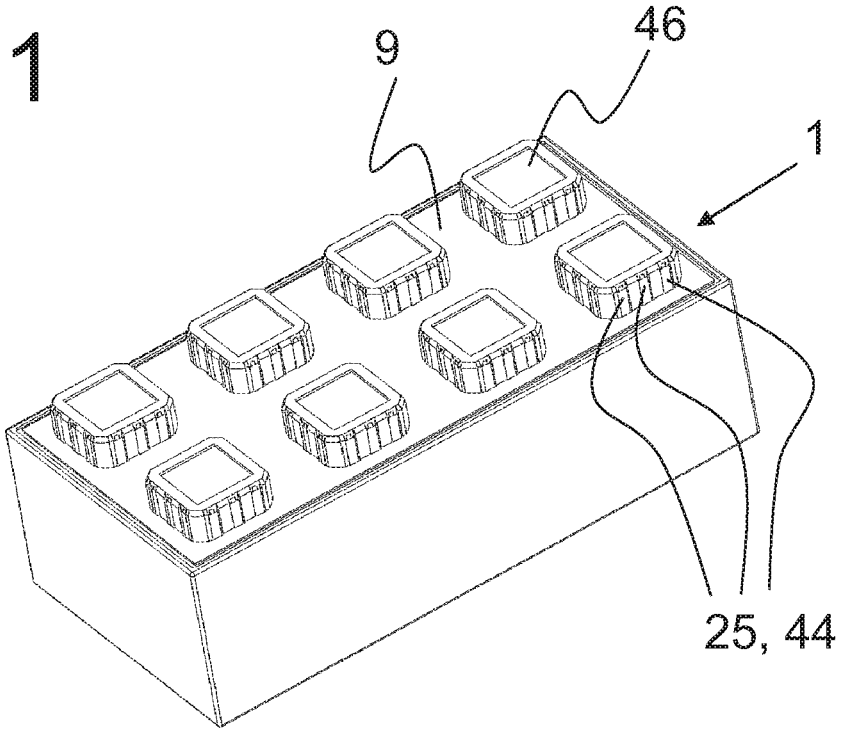
FIG. 11: A second variant of the plastic toy building block in a perspective view from above.

In the following, a second embodiment variant of the toy building block is presented and described with the help of FIGS. 11 to 14. This alternative is easier to manufacture industrially in large series at low cost, with the help of robots which can assemble the individual parts. First, FIG. 11 shows this alternative embodiment of the plastic toy building block in a perspective view from above. The contacts on the individual nubs 46 of the nub plate 39 are located here on the lateral walls of these nubs 46. Each lateral wall contains three contact surfaces of the conductor wires 25 present there, which are inserted into grooves 44 in the lateral walls of the nubs 46.

Figure 12:
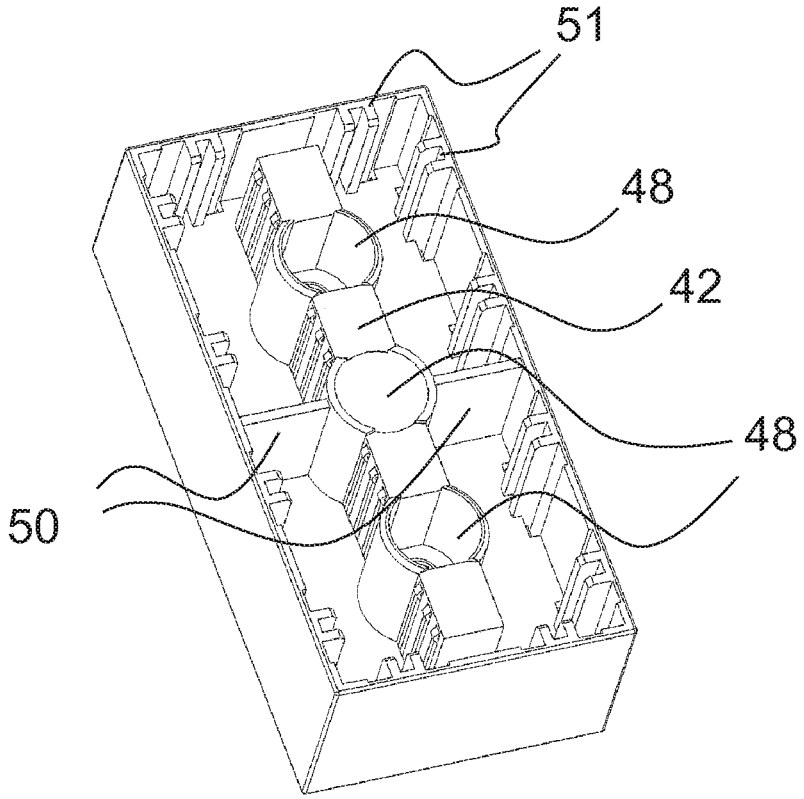
FIG. 12: The plastic toy building block according to FIG. 11 in a perspective view from below.

FIG. 12 shows this toy building block in a perspective view seen from below. On its underside, the toy building block is essentially hollow except for a central web 42 which extends along the longitudinal center of the toy building block. This bridge 42 here includes three hollow cylinders 48, the outer sides of which protrude slightly beyond the lateral walls of the bridge 42. For reinforcement, a cross bar 50 is installed. The lateral bars 51 create a clamping fit for the nubs 46 on the upper side of the same toy building block.

Figure 13:
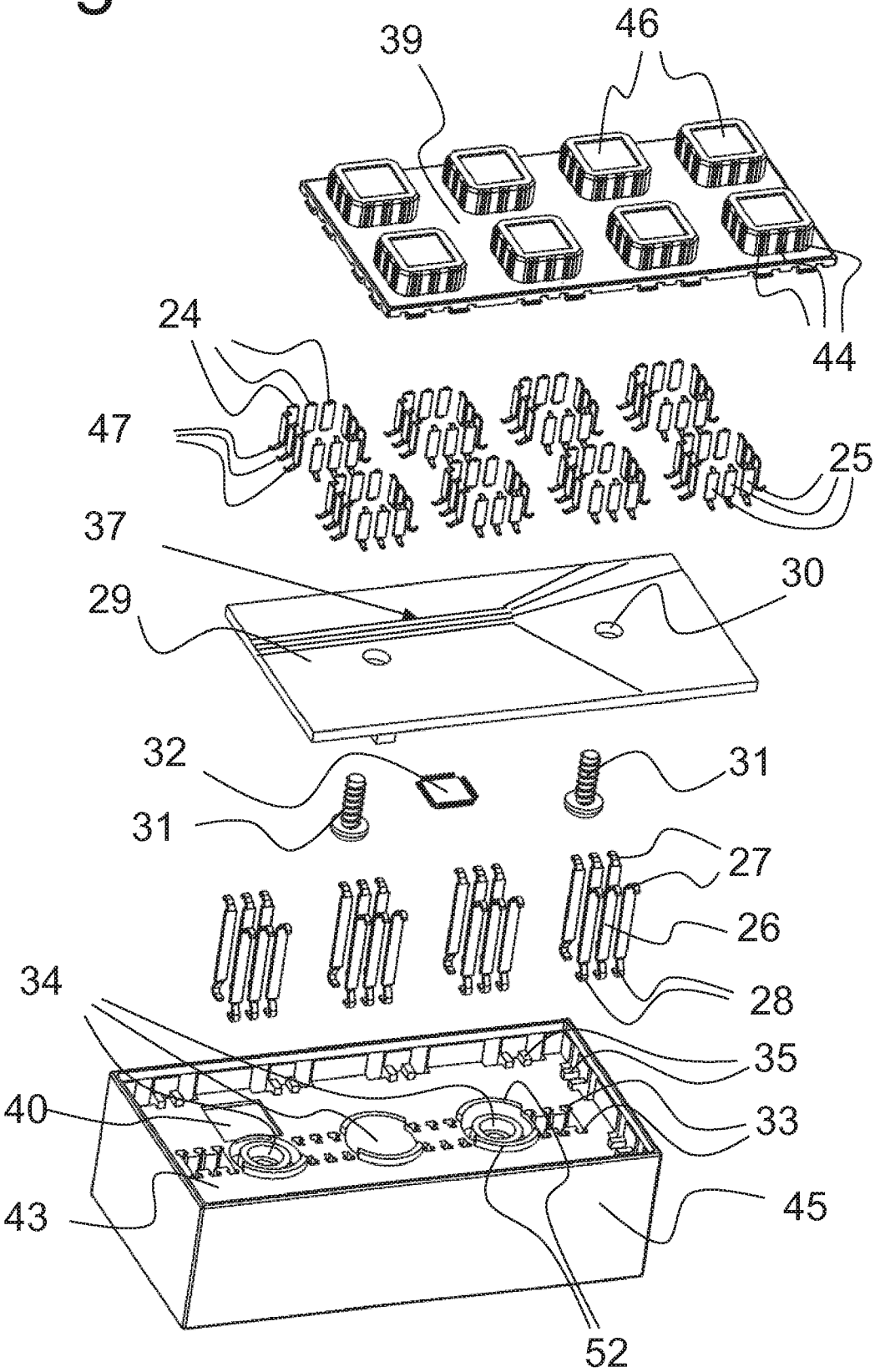
FIG. 13: The plastic toy building block according to FIG. 11 or 12 in a perspective exploded view seen from above, with all its parts.

FIG. 13 shows the plastic toy building block according to FIG. 11 or 12 represented in a perspective exploded view from above, at the bottom with the basic body 45 with its lowered upper side 43. This has three holes 34, wherein the outermost two serve in take screws 31, for the assembly with further parts. Along their circumference the holes 34 are equipped with ring-segment-shaped edges 52. These edges 52 serve as a support for the circuit board 29 to be inserted, which is represented above. The upper side 43 of the basic body 45 also shows a recess 40, into which a microchip 32 can be inserted, which is intended for the interconnection of the various lines and their intelligent networking. Along the longitudinal center of the upper side 43, insertion holes 33 can be seen, into which lower conductor wires 26 shown in the figure above the basic body 45 can be introduced. After the insertion, these conductor wires 26 project freely up to their upper angled end 27 into the lower cavity of the basic body 45, underneath the plate, which forms the upper side 43. At the lower end, the conductor wires 26 are formed into curved ends 28, which are elastic and flexible and act as contact surfaces with their outwardly facing lateral faces to the longitudinal sides of the basic body, which, as a result of the elastic resilient property when the toy building block is plugged onto the upper side of a same toy building block, cling to the lateral contact surfaces 25 on the nubs 46 on the upper side of this toy building block as a result of the resilient property. Along the upwardly projecting edge of the basic body 45, cams 35 are formed on the upper side of the plate, which forms the upper side 43 of the basic body 45. The circuit board 29 comes to rest on these nobs 35 when assembling the toy building block. As for the upper conductor wires 25 there are 8 units with 12 individual conductor wires 25 each. These conductor wires 25 can be inserted from below along the lateral faces of the nubs 45 on the nub plate 39 shown at the top through holes 38 (FIG. 14) in the nub plate 39 and thus through this nub plate 39 into the grooves 44 which are recessed in the lateral faces of the nubs 46. At upper end 24, these conductor wires 25 are angled, thus each forming one unwound end 24. These angled ends 24 can snap into place in transverse slots in the grooves 44, whereupon the conductor wires 25 are secured in the grooves 44. The outwardly directed sides of the conductor wires 25 each form a contact surface along the lateral nub faces, which establish an electrical contact with the outwardly projecting lower ends 28 of the lower conductor wires 26 when the same toy building block is plugged onto the lower ones. Depending on the position of the upper toy building block on the lower one, other electrical connections are made. The circuit board 29 having its two holes 30 has a large number of, for example, vapor-deposited electrical conductor tracks 37, which run along its upper and undersides and are guided around its edges, so that an electrical current can be guided along an upper conductor track 37 around the outer edge of the circuit board 29 and then along a lower conductor track 37. The lower ends 47 of the upper conductor wires 25 in the lateral walls of the nubs 46 touch the upper side of the circuit board 29 and in doing so make contact with the conductor tracks 37 running on it, and the upper ends 27 of the lower conductor wires 26 make contact equally with the lower conductor tracks on the underside of the circuit board 29.

Figure 14:
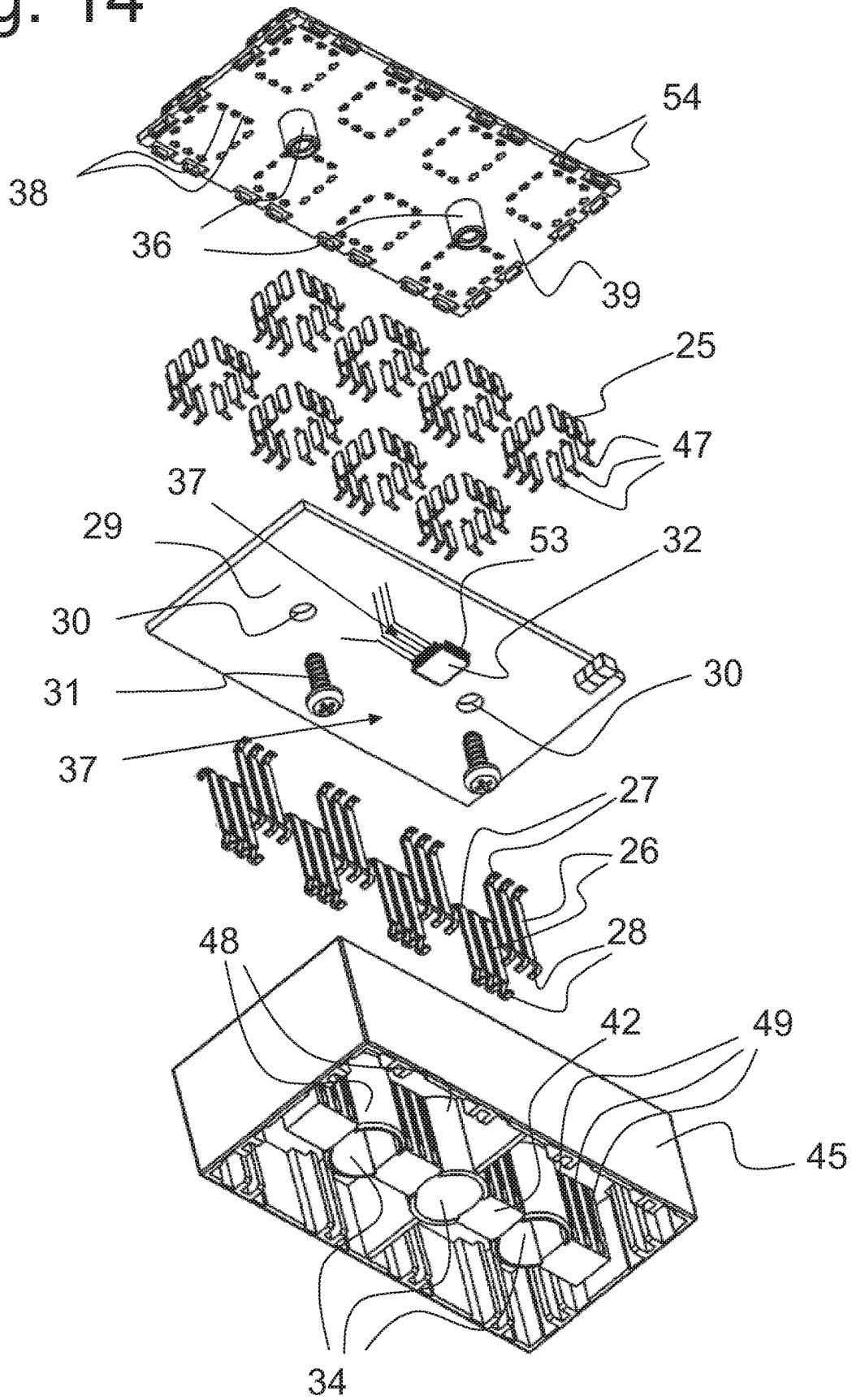
FIG. 14: The plastic toy building block according to FIG. 11 or 12 in a perspective exploded view seen from above, with all its parts.

FIG. 14 shows the same plastic toy building block according to FIG. 11 or 12, now, however, represented in a perspective exploded view from above, with all its parts; As one can recognize by a view from below into the basic body 45, the three holes 34 in the longitudinal middle web 42 end at the bottom. The hollow cylinders 48 projecting laterally from the longitudinally centered web 42 to the holes 34 act as clamping surfaces when the basic body 45 is inserted from above onto the nub plate 39 of the same toy building block. On the side of bridge 42, one recognizes the grooves 49, into which the lower conductor wires 26 can be inserted from above, after which their lower curved ends 28 protrude freely into the space below bridge 42. In the example shown, there are four triple packets of grooves 49. With a stone with only four nubs would be bare accordingly two triple packets of grooves 49. These curved ends 28 can make contact with the conductor wires 25 in the lateral faces of the nubs 46 on the nub plate 39 of a same toy building block on which this toy building block is placed as the upper toy building block. Above the basic body 45, one recognizes the lower conductor wires 26 having their curved ends 28, which can be inserted through corresponding holes 33 (FIG. 13) in the upper side 43 of the body 45 and then along the grooves 49 into the same. Onto these inserted lower conductor wires 26 and their upper ends 27, the circuit board 29 is placed from above. In doing so, the conductor paths 37 on the underside of the conductor plate 29 also make contact with the upwardly projecting contact feet 53 of the microchip 32 in the upper side of the basic body 45, for intelligent wiring of all conductors. The upper conductor wires 25 are pushed from below through the holes 38 in the nub plate 39 through the same into the grooves 44 in the lateral faces of the nubs 46, until they snap into the same, as already described. Then only the lower curved ends 47 of these conductor wires 25 protrude out of the nub plate 39. These lower ends 47 make contact with the conductors 37 on the upper side of the circuit board 29, which is not visible from below. The nub plate 39 furthermore has spacers 54 on its underside, with which it rests on the circuit board 29 after assembly to provide clearance for the lower resilient ends 47 of the upper conductor wires 25. All parts are assembled by placing the circuit board 29 on the upper side 43 of the basic body 45, and then placing the nub plate 39 on the upper side of the circuit board 29. Then the basic body 45 is screwed to the nub plate 39, for which two screws 31 are inserted from below into the outer holes 34 in the web 42. These screws 31 can then be screwed with their threads into the threaded bushings 36 formed on the underside of the nub plate 39, including the circuit board 29, which is then located between the lower ends 47 of the upper conductor wires 25 and the upper ends 27 of the lower conductor wires 26.

Figure 15:
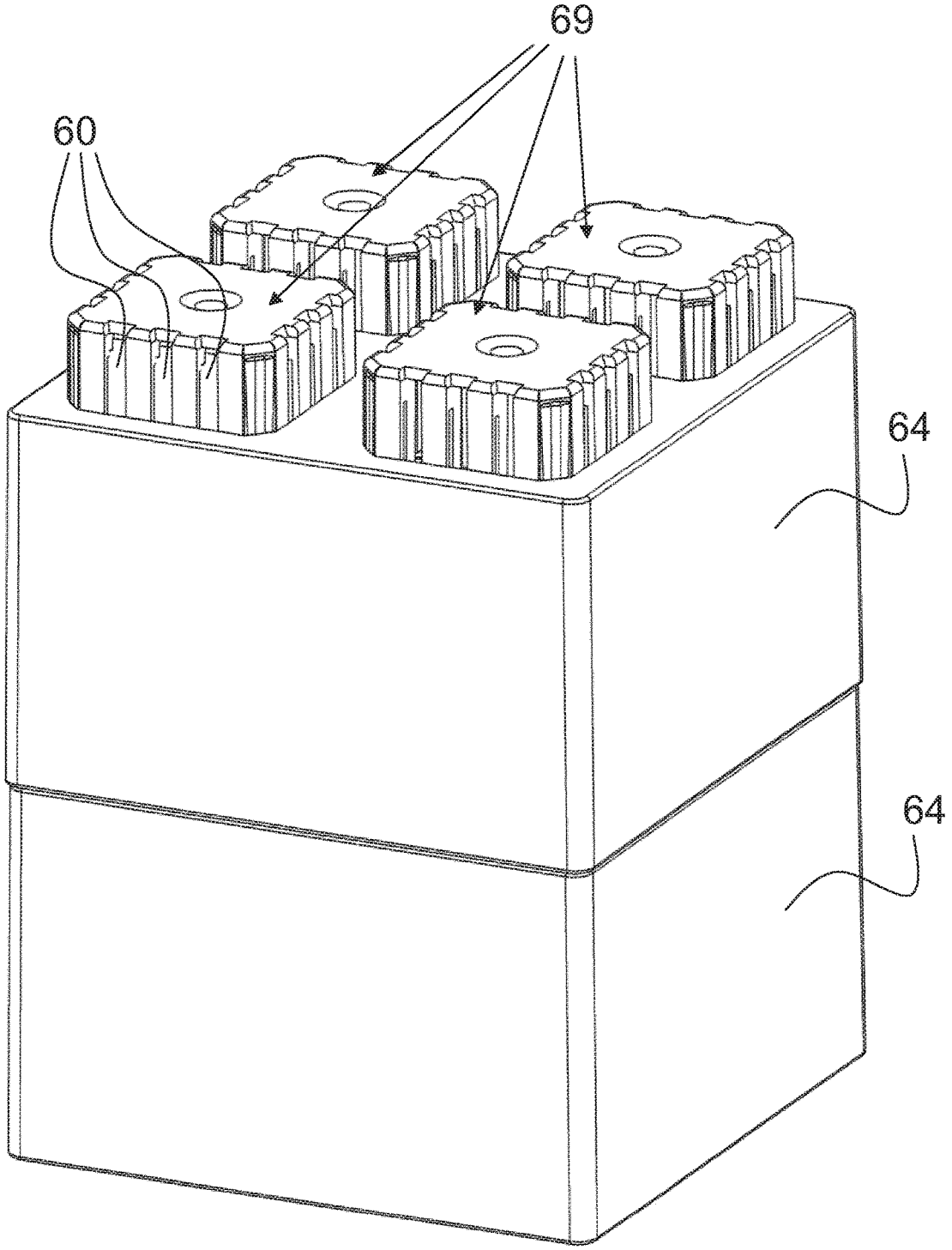
FIG. 15: Two alternative plastic toy building blocks placed on top of each other in a third embodiment variant, each having four nubs on its upper side.
Figure 16:
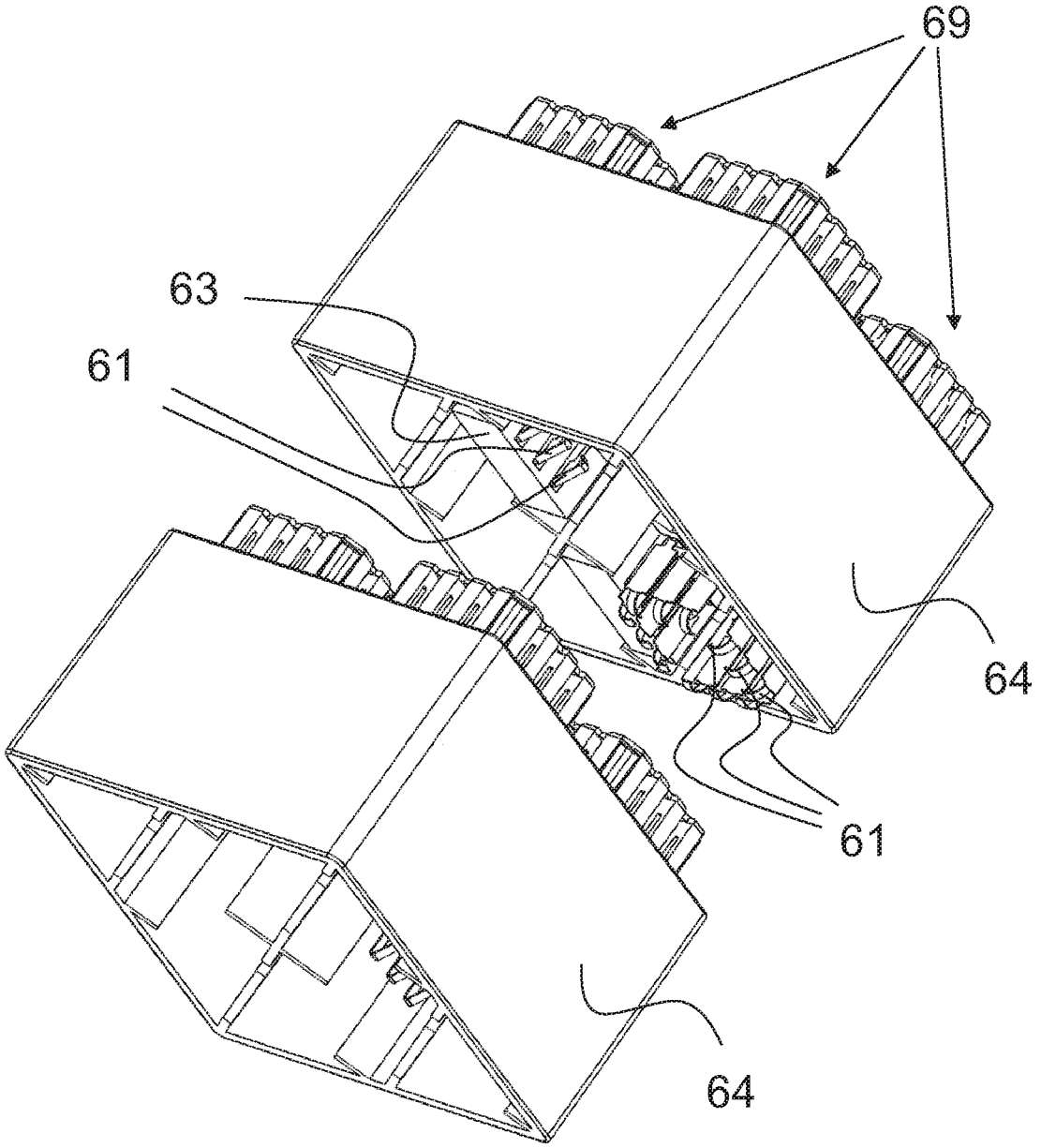
FIG. 16: The plastic toy building blocks according to FIG. 15 in separated state, viewed diagonally from below.

FIGS. 15 to 18 show a third embodiment variant of such plastic toy building blocks. Here in FIG. 15, two such plastic toy building blocks are fitted on top of each other and they each have four nubs 69 on their upper side. Three conductor wires 60 are guided in each flank of the nubs 69, which can come into contact with the inner or lower conductor wires projecting downwards of a plastic toy building block of the same type placed thereon. Of course, basic bodies 64 can also be built or injected with six, eight or even more nubs. In FIG. 16 these plastic toy building blocks according to FIG. 15 are shown in separated state viewed diagonally from below. In this illustration one recognizes the lower conductor wires 61 projecting downwards, which are held in special inserts 63, which can be inserted from below into the basic body 64 of the plastic toy building block and snapped into it.

Figure 17:
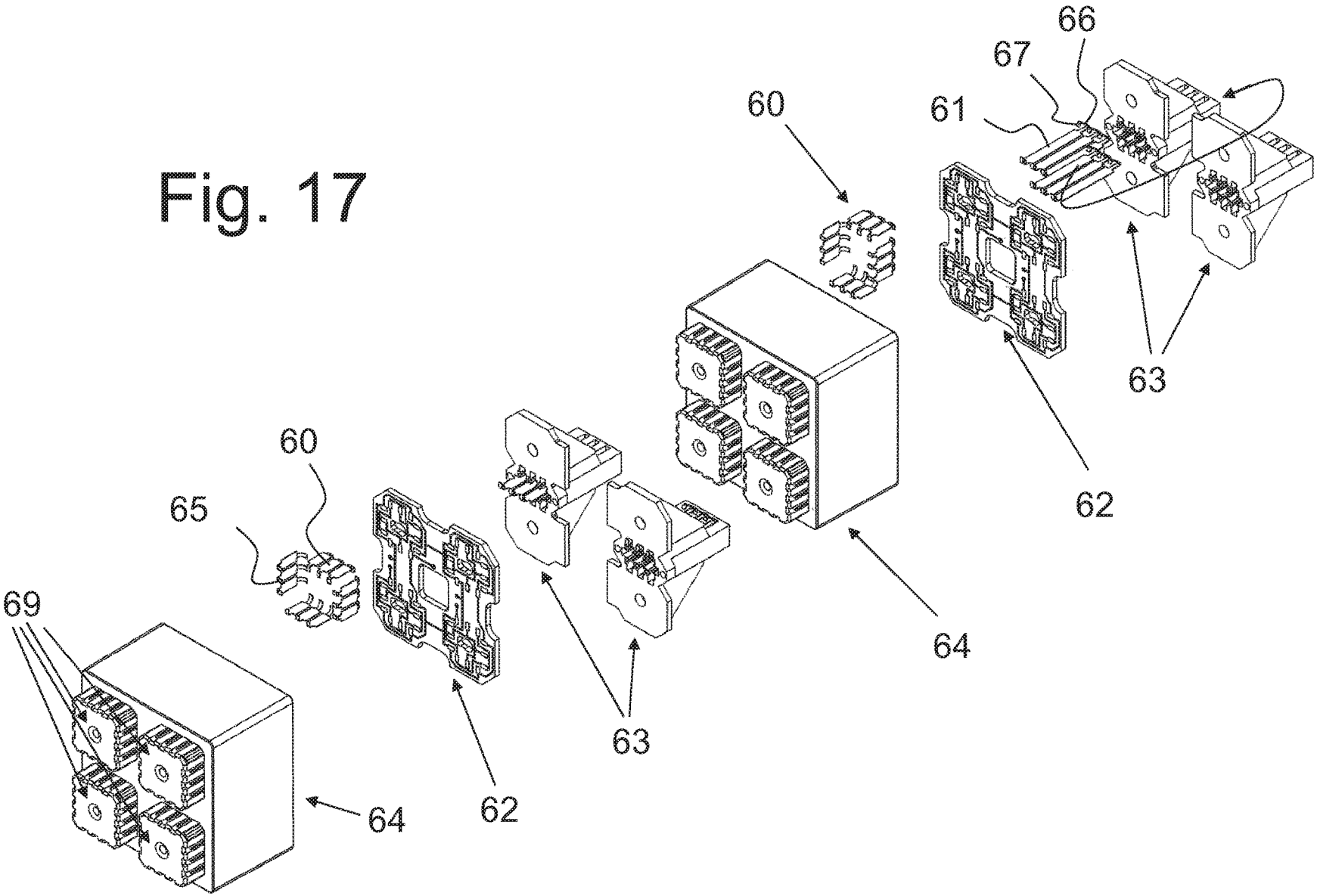
FIG. 17: The plastic toy building blocks according to FIGS. 15 and 16 in a lying position, seen diagonally from below, in an exploded view with all their parts inside.

FIG. 17 shows the two plastic toy building blocks according to FIGS. 15 and 16 in a lying position, seen diagonally from below, in an exploded view with all their parts inside. Starting from the bottom left of the picture, one recognizes the basic body 64 of the upper plastic toy building block having its four nubs 69 on its upper side. To the right of it or below the basic body 64, the upper conductor wires 60 are drawn. These are four triple packets of conductor wires 60, so that three conductor wires 60 each come to rest on each flank of a nub 69 in corresponding grooves in these nub flanks and are securely held in place by their upper hooks 65 hooking resiliently into recesses in these grooves. Towards the right or below one can recognize a contact plate 62 in the assembled state. In the assembled state, the lower ends of the upper conductor wires rest on the upper side of this contact plate 62. The black lines on the contact plate 62 show the different interconnections of the contact points. In the picture on the right of the contact plate 62 or, for the assembled toy building block below it, two insert parts 63 follow. These are used to accommodate and support the lower conductor wires 61, which are installed in one of the two mounting parts 63 shown here and protrude slightly from the top of the same, while the adjacent mounting part 63 is not yet equipped with its conductor wires. Towards the right of the drawing follows the next, lower plastic toy building block with its basic body 64. To the right of the same, one recognizes the nine upper conductor wires 60 for a nub 69, and to the right of it or below, the contact plate 62 with its wiring or interconnections. Further right in the drawing or below the contact plate 62, two packets of three lower conductor wires 61 each are represented. As indicated by the arrow, these are inserted from below, or in the drawing from the right, into corresponding grooves in the insert 63, which is shown in the drawing to the right of the conductor wires 61 or below them. Hereafter they protrude with their upper angled contact feet from the top of the insert, and in the assembled state of the plastic toy building block these then press from below onto the contact plate 62 and there make contact with the electrical contacts of the circuit. The lower ends 66 of the lower conductor wires 61 are angled at an angle of about 135° and their outermost end portions 67 are again angled at an angle of about 90° in the same direction. With their outer edge formed in this way, they thus form a resilient, yielding contact surface which slides over the outer side of the upper conductor wires 60 when this plastic toy building block is placed on a plastic toy building block of the same type. Correspondingly the contacts are closed, which allow conclusions to be drawn about the relative position of the two plastic toy building blocks fitted into each other.

Figure 18:
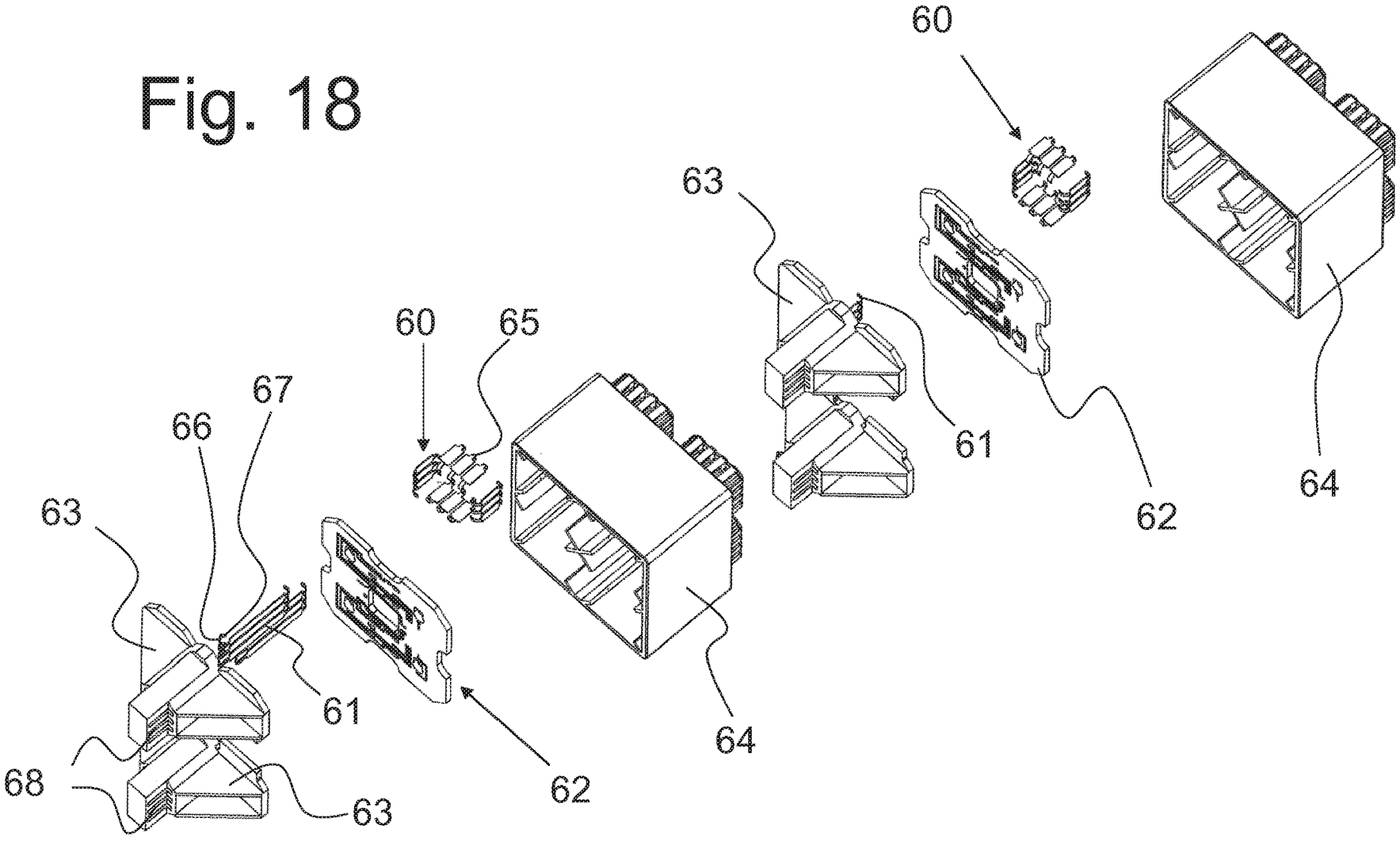
FIG. 18: The plastic toy building blocks according to FIGS. 15 and 16 in a lying position, seen diagonally from below, in an exploded view with all their parts inside.

FIG. 18 shows the two plastic toy building blocks according to FIGS. 15, 16 and 17 in a lying position, this time seen diagonally from above, in an exploded view with all their parts inside. Starting from the left in the picture, one recognizes two insert parts 63 having their grooves 68 for inserting the lower conductor wires 61 into these grooves 68 from below. The lower ends 66 of these lower conductor wires 61 are bent by about 135° each, so that they enclose an angle of about 45° with the remaining conductor wire. The outer ends 67 are again angled by about 90° and the outer edge thus formed acts as a resiliently yielding contact surface. Further to the right one can see the contact plate 62 with its wiring or interconnections. Further to the right is a packet of three times three upper conductor wires 60, each with an end 65 at the bottom and top angled at a 90°. While the lower angled ends act as contact feet resting on the contact plate 62, the upper unwindings act to lock the conductor wires 60 in the grooves of the flanks of the nubs 69 on the upper side of the plastic toy building block. Still further to the right follows the basic body 64 of the plastic toy building block. All these parts are again represented on the right for the plastic toy building block to be placed on top. One of the insert parts 63 shows the lower conductor wires 61 protruding from it at the top, with their ends unwound by 90° as contact feet for contact with the contact plate 62 to be placed above them. Above the contact plate 62, one again recognizes new upper conductor wires 60, although there are a total of four packet of nine of such upper conductor wires 60 each, and finally on the far right the basic body 64 of the upper plastic toy building block. The insert parts 63 and the contact plate 62 are designed such that they can be inserted from below into the basic body 64 of a plastic toy building block 64 and snapped into it, while the lower conductor wires 61 can be introduced into the grooves 68 on the insert parts 63, and the upper conductor wires 60 can be hooked into the grooves in the flanks of the nubs 69 and finally into these. In doing so, electrical connections are created from the upper conductor wires 60 to the six lower conductor wires 61 which project downwards at the bottom. Depending on the relative position of the two plastic toy building block fitted on top of each other, these or those contacts are effective, so that it is possible to determine whether an upper plastic toy building block is placed congruently or at on offset onto the lower toy building block, and if so, in which direction.

Two such toy building blocks as described so far in three variants can be placed on top of each other in any way, e.g. congruently seen from above, or shifted in longitudinal direction, i.e. two, four or even six nubs of the lower block are left exposed. The stones can also be placed at right angles to each other over two or four nubs of the block lying below, or also displaced lengthwise and covering two, three or four nubs. In each constellation, the conductor wires 25;60 in the lateral faces of the occupied nubs 6;46;69 are in contact with other lower conductor wires 26;61 on the upper toy building block and can thus close a circuit. Depending on which conductor tracks on the printed circuit board 29 or contact plate 62 carry corresponding current, the microprocessor 32 recognizes the constellation of the two toy building block with respect to each other and, via two of the conductors 26;61 opening downwards of a triple packet, it can pass this information on to a computer which can display the constellation correspondingly on a screen. If more blocks are placed on top, their constellation is equally relayed to the very bottom and finally displayed on a screen.

NUMERICAL INDEX

1. Variants (FIGS. 1 to 10)
1 Basic body
2 Lateral wall
3 Upper edge
4 Bottom in the toy building block
5 Nub plate
6 Nubs
7 Contact film
8 Upper side of the nub plate 5
9 Narrow edge of the nub plate
10 Film
11 Contact points on film
12 Cover plate
13 Frame on cover plate
14 Conductor wires
15 Recess in basic body 1
16 Triple packet of conductor wires 14
17 Plastic strip with holes
18 Plastic strip with bolts
19 Conductor on contact film
20 Mounting conductor
21 Contact surfaces at the bottom of conductor wires
22 Holes in plastic strip 17
23 Bolts on plastic strip 18
24 Upper contact points of the conductor wires
2. Variants: (FIGS. 11 to 14)
25 Upper conductor wires
26 Lower conductor wires
27 Upper ends of the lower conductor wires
28 Lower ends of the lower conductor wires
29 Circuit board between nub plate and basic body 1
30 Hole in mounting plate
31 Screws for mounting plate 29
32 Microprocessor
33 Insertion holes for the longitudinally centered lower conductor wires
34 Holes in basic body
35 Cams along the outer edge of the basic body for supporting the circuit board 29
36 Threaded bushes on mounting plate 29
37 Conducting pathways on the circuit board 29
38 Holes in the nub plate
39 Nub plate
40 Recess for microchip on basic body
41 Longitudinally centered holes in basic body 1
42 Bars between the longitudinally centered holes in the basic body
43 Lowered upper side of the basic body
44 Grooves in lateral faces of the nubs, for the upper conductor wires
45 Basic body second variant
46 Nubs second variant
47 Lower ends of upper conductor wires 25
48 Hollow cylinder in the bar 42
49 Grooves in bar 42 for inserting the lower conductor wires
50 Cross bar at the bottom of the basic body 45
51 Lateral bars on the basic body 45
52 Ring segments around the holes 34
53 Contact wires of the microchip
54 Spacer at the bottom of the nub plate 39
3. Variants: (FIGS. 15 to 18)
60 Upper conductor wires on nub flanks (FIG. 17/18)
61 lower conductor wires inside the basic body (FIG. 17/18)
62 Contact plate (FIG. 17/18)
63 Insert parts as holders for the conductor wires (FIG. 17/18)
64 Basic body
65 upper hooks on the upper conductor wires 60
66 lower ends of the lower conductor wires, angled at 135°
67 outer ends angled 90° at these ends
68 Grooves on the insert parts 63

What is claimed is:

1. A plastic toy building block comprising:

a basic body having a bottom, a top, opposite the bottom, and a plurality of recesses passing from the bottom to the top of the basic body and wherein the bottom of the basic body is operable to receive a second top of a second basic body;

a plurality of nubs extending from the top of the basic body, each of the plurality of nubs including at least one nub flank and a nub top;

a plurality of conductor wires contacting at one of the at least one nub flank, the plurality of conductor wires passing through at least one of the plurality of recesses from the bottom of the basic body to the top, wherein a first plurality of conduct wires of the plurality of conductor wires receive an electrical contact with a second plurality of conductor wires on second nubs of the second basic body;

a microprocessor, communicatively coupled with the plurality of conductor wires wherein the microprocessor is operable to determine a location of the basic body relative to the second basic body based on the received electrical contact of the second plurality of conductor wires;

a contact plate within the basic body, wherein the contact plate has electrical conductors passing therethrough;

the electrical conductors further comprising a plurality of top conductor wires and a plurality of bottom conductor wires;

grooves on at least one lateral nub flank of the at least one nub flank that receive the plurality of top conductor wires inserted from an interior of the basic body through the top of the basic body and electrically coupled to the electrical conductors; and an insert part that receives and holds the plurality of bottom conductor wires, wherein an upper end of each of the plurality of bottom conductor wires electrically couple to the contact plate from an underside of the contact plate, and wherein a lower end of each of the plurality of bottom conductor wires form a contact surface for a second plurality of top conductor wires from the second plurality of conductor wires on the second nubs of the second basic body.

2. The plastic toy building block according to claim 1, wherein the basic body is hollow and further comprises:

a nub plate within the basic body, the plurality of nubs being disposed on the nub plate;

the plurality of conductor wires inserted into the basic body, wherein the plurality of conductor wires are elastic and project within the basic body;

the plurality of nubs include a plurality of nub conductor wires electrically coupled to the plurality of conductor wires, wherein the plurality of conductor wires electrically couple to the second plurality of conductor wires.

3. The plastic toy building block according to claim 1, wherein the plurality of conductor wires further comprises:

upper conductor wires;

lower conductor wires;

a circuit board including the microprocessor, wherein the circuit board has electrical conductive tracks and is arranged between a nub plate and the basic body, the electrical conductive tracks forming an electrical connection between the lower conductor wires and the upper conductor wires;

the nub plate including holes along the at least one nub flank, wherein the nub plate and the circuit board are connected to the basic body; and the at least one nub flank operable to receive the upper conductor wires.

4. The plastic toy building block according to claim 3, wherein the upper conductor wires and the lower conductor wires are arranged at a contact-carrying end; and each of the at least one nub flank has at least one groove in the at least one nub flank to receive the upper conductor wires.

5. The plastic toy building block according to claim 4, further comprising:

at least one threaded bushing on a bottom side of the nub plate; and a base plate fastened to the nub plate by the at least one threaded bushing.

6. The plastic toy building block according to claim 4, wherein the basic body is screwed to the nub plate by screws that are screwed into at least one threaded bushing on a bottom side of the nub plate, including the circuit board, which is then located between the lower end of the upper conductor wires and the upper end of the lower conductor wires.

7. The plastic toy building block according to claim 4, wherein a cover plate has a collar projecting downwards and sits on the basic body, in which an upper edge thereof forms an inwardly offset step, wherein the cover plate is placed on top of the basic body to fit precisely and immovably, and securely held in place by clamps, click connections, screwing, welding, and/or gluing.

8. The plastic toy building block according to claim 4, wherein a cover plate has a collar projecting downwards which is slightly offset inwards so that the collar forms a circumferential step which can be placed on the basic body, and wherein the cover plate is placed on top of the basic body to fit precisely and immovably, and securely held in place by clamps, click connections, screwing, welding, and/or gluing.

9. A method for industrial production of the plastic toy building block according to claim 1 having electrical contacts for electronically determining positioning of the plastic toy building block in relation to the second basic body in an installed state, the method comprising:

a) lowering the plurality of conductor wires to be inserted into grooves in corresponding insert parts against frictional resistance;

b) inserting a plurality of upper conductor wires from below the basic body through the top of the basic body and longitudinally into grooves in the at least one nub flank until upper, angled ends of each of the plurality of upper conductor wires click into corresponding grooves and are thus held therein, wherein the plurality of upper conductor wires are a subset of the plurality of conductor wires;

c) inserting a contact plate into the basic body from the bottom, the contact plate establishing an electrical connection between the contact plate and the plurality of upper conductor wires; and d) inserting a plurality of insert parts into the basic body and snapping the insert parts therein, establishing an electrical connection between the contact plate and a plurality of lower conductor wires.

10. A method for industrial production of the plastic toy building block according to claim 1 having electrical contacts for electronically determining positioning of the plastic toy building block in relation to the second basic body in an installed state, the method comprising:

a) inserting a plurality of lower conductor wires into grooves in lateral faces of ribs of the basic body against frictional resistance, wherein the plurality of lower conductor wires are a subset of the plurality of conductor wires;

b) inserting a plurality of upper conductor wires through holes in a nub plate longitudinally into grooves in the at least one nub flank until upper, angled ends of the plurality of upper conductor wires click into corresponding grooves in the at least one nub flank, wherein the plurality of upper conductor wires are a subset of the plurality of conductor wires;

c) inserting a circuit board into the top of the basic body;

d) inserting the nub plate into the top of the basic body; and e) coupling the basic body, including the circuit board, to an underside of the nub plate.

* * * * *